8-107 SR
FIP8309 OR 4,321,052

United States Patent [19]
Smerz et al.

[11] 4,321,052
[45] Mar. 23, 1982

[54] USE OF ALKYLPOLYGLYCOL-TERT.-BUTYL ETHER AS BLEACHING AUXILIARY AND BLEACHING BATHS CONTAINING THIS AGENT

[75] Inventors: Otto Smerz, Kelkheim; Thomas Martini, Bad Soden am Taunus; Siegfried Billenstein, Burgkirchen; Klaus Adrian, Frankfurt am Main, all of Fed. Rep. of Germany

[73] Assignee: Hoechst Aktiengesellschaft, Fed. Rep. of Germany

[21] Appl. No.: 255,351

[22] Filed: Apr. 17, 1981

[30] Foreign Application Priority Data

Apr. 25, 1980 [DE] Fed. Rep. of Germany ..... 3015958

[51] Int. Cl.[3] ..... D06L 3/02; C11D 3/395
[52] U.S. Cl. ..... 8/107; 8/111; 252/186
[58] Field of Search ..... 8/107, 111; 252/186

[56] References Cited

U.S. PATENT DOCUMENTS 4,120,812 10/1978 Lutz ..... 8/107
4,131,562 12/1978 Lutz et al. ..... 8/111

FOREIGN PATENT DOCUMENTS 2556499 6/1977 Fed. Rep. of Germany .

*Primary Examiner*—A. Lionel Clingman
*Attorney, Agent, or Firm*—Connolly and Hutz

[57] ABSTRACT

A process for the bleaching of cellulose in an alkaline peroxide bleaching bath in the presence of a compound of the formula

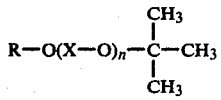

wherein R is $C_6$–$C_{22}$-alkyl, $C_6$–$C_{22}$-alkenyl or $C_6$–$C_{22}$-alkylaryl, n is a number of from 5 to 50, and X is ethylene or propylene; the ether chain $(X\text{–}O)_n$ consisting entirely of ethoxy units or contains n/5 isopropoxy units at most.

3 Claims, No Drawings

USE OF ALKYLPOLYGLYCOL-TERT.-BUTYL ETHER AS BLEACHING AUXILIARY AND BLEACHING BATHS CONTAINING THIS AGENT

As is known, alkaline peroxide bleaching baths used for bleaching cellulose are protected against too rapid decomposition by adding stabilizers. The bleaching baths contain futhermore anionic or nonionic wetting agents such as alkanesulfonates or alkylbenzenesulfonates, or addition products of ethylene oxide or propylene oxide onto compounds containig active oxygen, for example alcohols or phenols. These wetting agents are to ensure rapid and uniform wetting of the goods. However, in the case of high-speed apparatus with winches or jigs, foam formation may occur when using anionic or nonionic wetting agents, which causes serious trouble in the operations. In order to avoid such trouble, defoamers are added to the bleaching baths, which of course must be stable to alkali, to heat and to peroxides. Bleaching formulations contain therefore always a multitude of individual components, and it was thus the object of the invention to find substances which meet all cited requirements simultaneously.

In accordance with the invention, it has now been found that alkylpolyglycol-tert.-butyl ethers are suitable as stabilizers in alkaline peroxide bleaching baths, and that these compounds act simultaneously as wetting agent nearly or completely free from foam.

Subject of the invention is therefore a process for the bleaching of cellulose in an alkaline peroxide bleaching bath in the presence of a compound of the formula

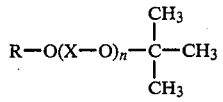

wherein R is $C_6$–$C_{22}$-alkyl, $C_6$–$C_{22}$-alkenyl or $C_6$–$C_{22}$-alkylaryl, n is a number of from 5 to 50, and X is ethylene or propylene; the ether chain $(X—O)_n$ consisting entirely of ethoxy units or contains n/5 isopropoxy units at most.

The compounds of the above formula are known from German Offenlegungsschrift No. 2,556,499. Preferred are those compounds in which R is alkyl, alkenyl or alkylaryl each having from 8 to 18 carbon atoms. The alkyl and alkenyl groups, respectively, may be linear or branched. Preferred as aryl group is phenyl.

The bleaching bath is composed as usual and contains as bleaching agent hydrogen peroxide or compounds forming hydrogen peroxide in aqueous solution. The pH of the bleaching baths is adjusted to 9 to 14, preferably 11 to 13, by means of alkali such as sodium hydroxide or sodium carbonate. From 0.5 to 5, preferably 0.5 to 3, g/liter of the auxiliary according to the above formula are added to such bleaching baths. When bleaching in short liquor where the hydrogen peroxide concentration is 10 to 20 times higher than in the case of bleaching in long liquor, the amount of auxiliary is raised to up to 20 g/liter. The compounds of the above formula can be used individually or as mixtures with one another, anhydrous or in the form of aqueous formulations. Addition of further usual stabilizers, wetting agents and defoamers is of course possible.

The alkylpolyglycol-tert.-butyl ethers are free from foam especially in the case where the temperature of the bleaching bath is above the cloud point of these auxiliaries, so that there remains a partial turbidity only or even none at all. On use of these compounds below their cloud point, foam formation is suppressed to a certain extent, but the bath is not completely free from foam. Therefore, the preferred bleaching temperature is in a range of from 60° to 100° C. The cloud point of the above auxiliaries can be varied, that is, raised, by adding oxethylated alkylphenols, the amount of which (nonylphenol having from 5 to 50 ethylene oxide units being preferred) may be up to 95 weight %, relative to the sum of alkylpolyglycol-tert.-butyl ether and alkylphenol oxalkylate.

In the following examples which illustrate the invention, among others, the peroxide decomposition is observed for a period of up to 2 hours. A bleaching time of from 10 to 30 minutes is important in the practice. The cellulose material to be bleached may be cotton, linen, grey cotton cloth, jute, regenerated cellulose or mixtures of cellulose with synthetic fibers. After bleaching, the bleached goods are rinsed and dried. Subsequently, degree of whiteness, rate of absorption and polymerization degree are determined as criteria of effectiveness. The stabilizing activity of the alkylpolyglycol-tert.-butyl ethers is measured during the bleaching operation by titrimetric determination of the peroxide content. The foaming behavior of the bleaching baths is tested at 80° C. In order to produce a substantial motion of the liquor, in laboratory tests the bleaching liquor is pump-circulated through a vertical tube. After leaving the tube, the liquor jet drops 30 cm and hits the bath in a calibrated heatable recipient. The height of the foam formed within 1 minute is measured, and the time of foam decompsition is recorded.

EXAMPLE 1

Raw cotton knitted fabric was bleached on a winch at a goods-to-liquor ratio of 1:20 with a bleaching liquor I having the following composition;

4 ml/l of hydrogen peroxide (35% strength)

1 g/l of caustic soda 1 g/l of the compound of the formula

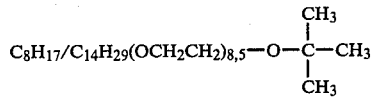

(cloud point 40° C.)

The bleaching liquor was heated to 90° C. within 30 minutes, and maintained for 120 minutes at this temperature. The water of the bleaching liquor was a mixture of tap water and deionized water in a ratio of 1:1 and had about 10° of German hardness. The peroxide consumption was determined titrimetrically by means of potassium permanganate every 15 minutes. After termination of the bleaching operation, the goods were rinsed at 70° C., by hydroextracted and dried.

For a comparison, the above goods were bleached under the same conditions using a normal bleaching liquor II composed as follows:

4 ml/l of hydrogen peroxide (35%)

1 g/l of caustic soda 1 g/l of a stabilizer on the basis of ethylenediaminetetraacetic acid-MG-di-Na salt 1 g/l of sec. alkanesulfonate as wetting agent.

The following results were obtained:

| | peroxide content after min | | | | | foam amount in cm measured after sec | | |
|---|---|---|---|---|---|---|---|---|
| | 30 | 45 | 60 | 90 | 120 | 30 | 60 | 120 |
| bleaching liquor I | 77.8 | 71.1 | 63.3 | 55.6 | 48.9 | 0 | 0 | 0 |
| bleaching liquor II | 58.9 | 52.2 | 47.8 | 40.9 | 36.7 | 21 | 20 | 19 |

| | degree of[1] whiteness | polymeriza-[2] tion degree | Absorption[3] in cm after | | | |
|---|---|---|---|---|---|---|
| | | | 10 | 30 | 60 | 120 sec |
| bleaching liquor I | 86.4 | 1900 | 2.6 | 3.4 | 4.1 | 5.0 |
| II | 86.4 | 1870 | 2.0 | 3.2 | 4.0 | 4.9 |

[1]determined by means of Elrepho (Zeiss), filter R 46; the starting degree of whiteness of the knitted fabric used was 56.3%.
[2]Polymerization degree of the raw goods: 2400, determined with Cu EN in Ubbelohde viscometer.
[3]The absorption of the treated goods was determined as follows: strips having a width of 2 cm and a length of 20 cm of the goods dried in air were dipped into a 2.5% solution of the dyestuff Patent Blue V, and the height of rise was determined relative to time.

The indicated values demonstrate clearly that the bleaching formulation containing the alkylpolyglycol-tert.-butyl ether has a better effect as compared to a bleaching liquor of usual composition.

The same results are obtained when the same ether as indicated above containing however 6.5 oxethylene units and having a cloud point of 30° C. is used as auxiliary.

EXAMPLE 2

Peroxide open width bleaching (Padroll process) A desized cotton fabric was padded with a bleaching liquor I and II, respectively, composed as indicated below, at a liquor uptake of 90%, and heated to 90° C. within 30 minutes by means of direct steam. Subsequently, the goods were rinsed two times at 60° C., and two times with cold water.

Bleaching liquor I:

30 g/l of hydrogen peroxide (35%)

4 g/l of caustic soda 8 g/l of the compound of the formula

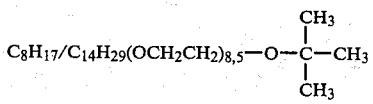

Bleaching liquor II:

30 g/l of hydrogen peroxide (35%)

4 g/l of caustic soda 8 ml/l of waterglass 38° Be 5 g/l of a sec. alkanesulfonate-containing wetting agent.

Liquor I is free from foam, while liquor II foams heavily. The results obtained with the two liquors are the following:

| | degree of whiteness | polymeriza-tion degree | Absorption after | | | |
|---|---|---|---|---|---|---|
| | | | 30 | 60 | 120 | 180 sec |
| bleaching liquor I | 86.5 | 1675 | 3.2 | 4.1 | 5.3 | 6.1 |
| bleaching liquor II | 86.5 | 1680 | 2.9 | 3.1 | 5.1 | 6.0 |

At practically identical values for the degree of whiteness, the polymerization degree and the absorption, liquor I has the advantage of being free from foam.

EXAMPLE 3

A bleaching liquor containing 50 ml/l of hydrogen peroxide, 18.75 g/l of caustic soda and 6 g/l of a mixure of 84% of the alkylplolyglycol-tert.-butyl ether used in Example 1 and 16% of an oxethylated nonylphenol containig 23 ethylene oxide units was examined for 72 hours for its peroxide content. The water of this bleaching liquor was a mixture of deionized water and tap water in a 1:1 ratio. Reduction of the peroxide content by 10% was observed. The same bleaching liquor, but without the alkylpolyglycol-tert.-butyl ether additive, showed a peroxide loss of 25% within the same period of time.

EXAMPLE 4

(a) Desized cotton fabric was dipped into a liquor (deionized water:tap water=1:1) containing 50 ml/l of $H_2O_2$ (35%), 20 g/l of caustic soda and 5 g/l of a commercial wetting agent on the basis of sec.-alkanesulfonate, and 3 g/l of the product having the formula

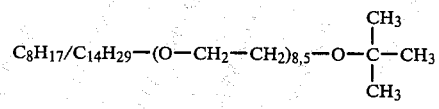

and squeezed between rolls to a liquor uptake of 100%. The operation was repeated, and the impregnated fabric stored for 16 hours at room temperature while being wrapped in protective polyethylene sheets. Subsequently, the fabric was washed with hot water in a ratio of 1:20, and degree of whiteness, absorption and polymerization degree were determined.

(b) Operations were as described sub (a); the formulation being the following:

5 g/l of a commercial wetting agent on the basis of sec.-alkanesulfonate 5 g/l of a commerical stabilizer on the basis of aminomethylenephosphonic acid.

The following results were obtained:

| | degree of whiteness | Absorption after 5 min in cm | polymerisation degree |
|---|---|---|---|
| Ex. (a) | 83.6 | 7.2 | 1870 |
| Ex. (b) | 83.8 | 6.4 | 1840 |

The starting polymerization degree was 2300. Although in test (a), the stabilizer and the wetting agent are replaced by one component only, a practically identical degree of whiteness is obtained.

What is claimed is:

1. A process for the bleaching of cellulose in an alkaline peroxide bleaching bath in the presence of a compound of the formula

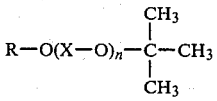

wherein R is $C_6$–$C_{22}$-alkyl, $C_6$–$C_{22}$-alkenyl or $C_{22}$-alkylaryl n is a number of of from 5 to 50, and X is ethylene or propylene; the ether chain $(X—O)_n$ consisting entirely of ethoxy units or contains n/5 isopropoxy units at most.

2. The process as claimed in claim 1 in the presence of an alkylplolyglycol-tert.-butyl ether wherein R is alkyl, alkenyl or alkylaryl each having from 8 to 18 carbon atoms.

3. Alkaline peroxide bleaching baths containing an alkylplolyglycol-tert.-butyl ether as represented by the formula given in claim 1.

* * * * *